US009157196B2

(12) United States Patent
McSwain et al.

(10) Patent No.: US 9,157,196 B2
(45) Date of Patent: Oct. 13, 2015

(54) ADHESIVELY SECURED ARTIFICIAL TURFS FOR AIRPORTS AND METHODS OF INSTALLING SUCH ARTIFICIAL TURFS

(75) Inventors: Daniel C. McSwain, Newnan, GA (US); Timothy M. Connelly, Swedesboro, NJ (US)

(73) Assignee: AvTurf L.L.C., Southlake, TX (US)

( * ) Notice: Subject to any disclaimer, the term of this patent is extended or adjusted under 35 U.S.C. 154(b) by 903 days.

(21) Appl. No.: 13/187,735

(22) Filed: Jul. 21, 2011

(65) Prior Publication Data

US 2013/0022763 A1 Jan. 24, 2013

(51) Int. Cl.
*E01C 13/08* (2006.01)
*E01C 9/00* (2006.01)

(52) U.S. Cl.
CPC . *E01C 13/08* (2013.01); *E01C 9/00* (2013.01); *D10B 2505/202* (2013.01)

(58) Field of Classification Search
CPC ..... E01C 13/08; E01C 9/00; D10B 2505/202
USPC ..... 404/72, 82; 428/17, 88
See application file for complete search history.

(56) References Cited

U.S. PATENT DOCUMENTS

| | | | | |
|---|---|---|---|---|
| 1,939,846 | A | 12/1933 | Fenton | |
| 1,949,063 | A | 2/1934 | Merrill | |
| 3,625,011 | A | 12/1971 | Stevenson | |
| 3,661,687 | A | 5/1972 | Spinney et al. | |
| 3,687,021 | A | 8/1972 | Hensley | |
| 4,067,757 | A * | 1/1978 | Layman | 156/71 |
| 4,091,625 | A | 5/1978 | Fontana et al. | |
| 4,152,473 | A | 5/1979 | Layman | |
| 4,183,984 | A | 1/1980 | Browers et al. | |
| 4,241,532 | A | 12/1980 | Fancy | |
| 4,268,551 | A * | 5/1981 | Moore, Jr. | 428/17 |
| 6,132,137 | A | 10/2000 | Gunter | |
| 6,242,062 | B1 | 6/2001 | de Vries | |
| 6,620,482 | B2 | 9/2003 | Carr et al. | |
| 6,794,007 | B2 | 9/2004 | Carr et al. | |
| 7,128,497 | B2 | 10/2006 | Daluise | |
| 7,175,362 | B2 | 2/2007 | Carr et al. | |
| 7,198,427 | B2 | 4/2007 | Carr et al. | |
| 7,260,297 | B2 | 8/2007 | Hajto et al. | |
| 7,806,625 | B2 | 10/2010 | Carr et al. | |
| 7,901,753 | B2 | 3/2011 | Carr et al. | |
| 2002/0136846 | A1 * | 9/2002 | Prevost | 428/17 |
| 2002/0146519 | A1 * | 10/2002 | Carr et al. | 428/17 |
| 2003/0182855 | A1 * | 10/2003 | Prvost | 47/58.1 R |
| 2003/0215287 | A1 * | 11/2003 | Prevost | 404/71 |

(Continued)

OTHER PUBLICATIONS

International Search Report and Written Opinion issued Jul. 6, 2012 for related Intl. Appln. No. PCT/US2012/033448.

(Continued)

*Primary Examiner* — Cheryl Juska
(74) *Attorney, Agent, or Firm* — K&L Gates LLP

(57) ABSTRACT

A method for installing artificial turf at an airport or airfield includes removing or milling a portion of an airport runway or taxiway to create a new surface of the runway or taxiway, adhering a section of artificial turf to the new surface of the runway or taxiway and applying an infill to at least a portion of the artificial turf. An artificial turf system for an airport includes an airport runway or taxiway having a removed or milled surface, an artificial turf is adhesively secured to the new, milled surface of the airport runway or taxiway and an infill layer installed on at least a portion of the artificial turf.

15 Claims, 5 Drawing Sheets

(56) References Cited

U.S. PATENT DOCUMENTS

| | | | | |
|---|---|---|---|---|
| 2004/0005194 | A1 | 1/2004 | Williams et al. | |
| 2004/0058095 | A1* | 3/2004 | Carr et al. | 428/17 |
| 2004/0058096 | A1* | 3/2004 | Prevost | 428/17 |
| 2004/0146352 | A1* | 7/2004 | Carr et al. | 404/75 |
| 2004/0234719 | A1* | 11/2004 | Jones | 428/62 |
| 2005/0031803 | A1* | 2/2005 | Prevost | 428/17 |
| 2005/0129903 | A1* | 6/2005 | Carr et al. | 428/85 |
| 2006/0088380 | A1* | 4/2006 | Prevost | 404/75 |
| 2007/0137017 | A1* | 6/2007 | Knox | 29/428 |
| 2008/0032069 | A1* | 2/2008 | Carr et al. | 428/17 |
| 2008/0175665 | A1* | 7/2008 | Prevost | 404/71 |
| 2008/0226392 | A1 | 9/2008 | Lloyd | |
| 2009/0166469 | A1* | 7/2009 | Prevost et al. | 244/110 R |
| 2010/0028078 | A1* | 2/2010 | Carr et al. | 404/31 |
| 2010/0030709 | A1 | 2/2010 | Carr | |
| 2012/0112002 | A1* | 5/2012 | Husseiny et al. | 244/114 R |
| 2012/0186729 | A1* | 7/2012 | O'Connor et al. | 156/157 |

OTHER PUBLICATIONS

International Preliminary Report on Patentability issued Jul. 11, 2013 for related Intl. Appln. No. PCT/US2012/033448.

* cited by examiner

ADHESIVELY SECURED ARTIFICIAL TURFS FOR AIRPORTS AND METHODS OF INSTALLING SUCH ARTIFICIAL TURFS

BACKGROUND

The present disclosure relates generally to systems and methods for securing artificial turf around airports or airfields and more specifically to systems and methods for adhesively installing artificial turfs around airports or airfields.

Airfields, including military airfields, small airfields and large commercial airports often have natural grass surfaces adjacent to the airport runways and taxiways. Those natural grass surfaces are difficult, time consuming, expensive to maintain and are aesthetically unpleasing. Natural grass surfaces can also create a number of safety problems for departing and arriving aircraft and potential safety problems relating to the clean-up of hazardous waste spills and to the use of pesticides and herbicides necessary for proper upkeep of the grass.

Various systems and methods have been developed for installing and securing artificial turf around airport runways and taxiways to help solve some of the problems associated with existing natural grass surfaces. For example, U.S. Patent Publication No. 2010/0030709 to Carr, which is assigned to the assignee of the present disclosure, teaches various systems and methods securing the artificial turf near a runway or taxiway. One such method uses a header system. The header system generally includes a composite stud member that serves as an anchor onto which the artificial turf is attached and/or a member that protects the edge from high velocity engine jet blasts and forces of natures (e.g., high winds) that can cause the artificial turf to fly-up or become removed from an underlying base material. In one such system, the artificial turf is glued to a header or stud member that is porous. The porous header can be glued to the runway or taxiway.

Using header systems to securely install artificial turf adjacent to runways or taxiways, however, has its own problems. For example, a header system can be costly to install due to the time (i.e., labor costs) and related material costs.

In another known system for securing artificial turf adjacent to runways, which is also disclosed in U.S. Patent Publication No. 2010/0030709 to Carr, the artificial turf is secured to a base material (e.g., sand or crushed rock) located under the runway using mechanical pinning or attachment devices, or secured merely via the weight of the base material. However, these known systems and methods for securing artificial turf adjacent to runway or taxiways can also be costly.

A need accordingly exists for an improved system and method for securing artificial turf adjacent to airport runways or taxiways.

SUMMARY

The present disclosure provides systems and methods for securing and installing artificial turf around airport runways or taxiways (including any shoulder(s) of the runway or taxiway) without the need for additional mechanical securing mechanisms. In one system and method of the present disclosure, a portion of an existing runway or taxiway located near an edge of the taxiway or runway is removed, milled or otherwise modified to a specific depth and width so as to define a surface. The depth of the new, removed or milled runway or taxiway surface in an embodiment is about 80% to about 100% of the height of the artificial turf or fibers extending from the turf (e.g., ranging between about one (2.5 cm) and one-half inches (3.8 cm) to about three inches (7.62 cm). The width of the removed or milled runway or taxiway surface can, for example, be in the range of up to ten feet (30.5 m). A section of artificial turf is adhered to the new, removed or milled surface of the runway or taxiway. The new, removed surface of the existing runway or taxiway creates a new edge that protects the artificial turf from flying-up or becoming removed from a base material located underneath the artificial turf. An infill layer is then installed on at least a portion of the artificial turf to further secure the turf near the airport runway or taxiway, and to help with water drainage, and to absorb noise created at the airport area.

In another system and method, an existing runway or taxiway surface located near an edge of the runway or taxiway is removed, milled or otherwise modified at a downward angle so as to create a tapered surface. That is, the depth of the new, removed or milled runway or taxiway surface increases in a direction extending away from an existing edge of the runway or taxiway sidewall. A section of artificial turf is adhered to the new tapered surface of the runway or taxiway surface. Tapering the new, removed or milled surface of the runway or taxiway reduces the time and cost of removing or milling of the taxiway or runway surface while still creating a new edge that protects the artificial turf from flying-up or becoming removed from a base material located under the artificial turf. An infill layer is again installed on at least a portion of the artificial turf to help secure the turf near the airport runway or taxiway, to help water drainage, and to help reduce the amount of noise escaping the airport area, for example.

In addition to the above-described methods of installing artificial turf systems at airports or airfields, various artificial turf systems for an airport or airfield are themselves provided in the present disclosure. One such system includes an airport runway or taxiway having a surface that has been removed, milled or otherwise modified to a specific depth and height. An artificial turf is adhesively secured to the new, removed or milled airport runway or taxiway surface. At least a portion of the artificial turf includes an infill layer.

Another airport or airfield artificial turf system of the present disclosure is adapted for parachute landing. The system includes an artificial turf having a 100% rubber infill layer that provides a cushioned landing area for parachuters. The landing system may also have one or more layer of padding beneath the artificial turf. The padding may be porous or perforated for water drainage. The padding may alternatively be sloped for water drainage.

It is accordingly an advantage of the present disclosure to provide improved methods of installing artificial turf near airport runways or taxiways.

It is a further advantage of the present disclosure to provide improved artificial turf systems installed around airports or airfields.

It is a further advantage of the present disclosure to reduce airport artificial turf installation costs and to simplify installation procedures.

It is yet a further advantage of the present disclosure to provide an artificial turf system with a cushioned landing area for parachuters.

Additional features and advantages are described herein, and will be apparent from the following Detailed Description and the figures.

DETAILED DESCRIPTION

Figure 1:
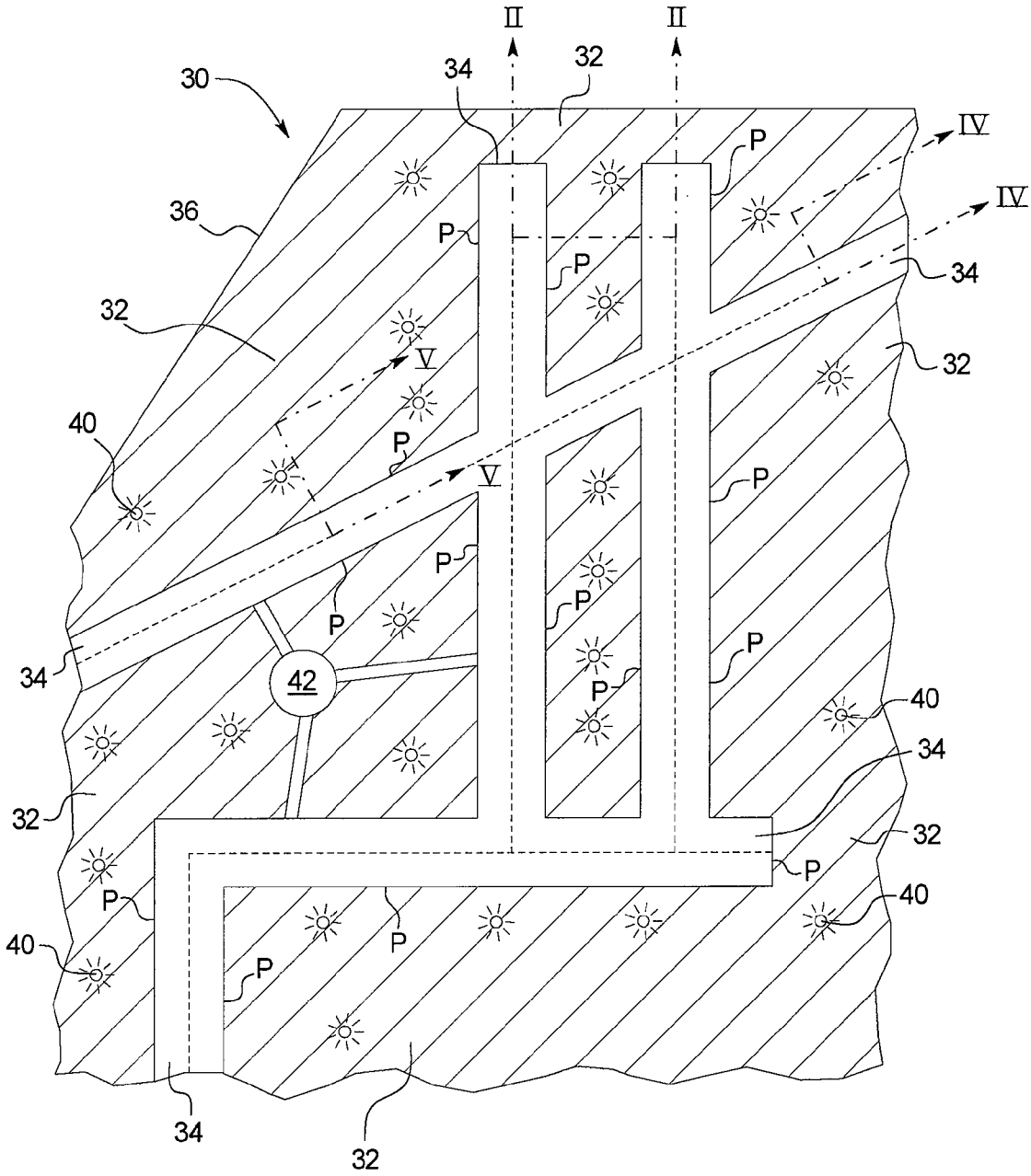
FIG. 1 is a sectioned top plan view of an airport or airfield, illustrating sections of airport runways, taxiways and areas of adjacent artificial turf of the present disclosure.

Referring now to the drawings, and in particular to FIG. 1, an airport or airfield 30 employing the present disclosure has runways, taxiways (including any shoulder(s) of the runways or taxiways) and areas of synthetic turf 32 adjacent thereto. The artificial turf areas 32 can be installed adjacent to the runways or taxiways 34 (including any shoulder(s) of the runways or taxiways) or sections thereof. The present disclosure contemplates installing the artificial turf areas 32 adjacent to or substantially adjacent to all the runways or taxiways 34 (including any shoulder(s) of the runways or taxiways). It is possible that certain presently existing runways or taxiways contain obstacles, such as drains, etc., along their side surfaces that do not allow the turf to be uniformly applied directly along their edge or side surfaces. The turf of the present disclosure, however, is installed adjacent to the runway/taxiway wherever possible.

The artificial turf areas 32 are installed on one or both sides of a runway/taxiway 34 and their surrounding areas, as desired by the airport operator, builder or maintainer. The greater the artificial turf area 32, the greater the benefit, such as the prevention of bird strikes and land erosion, improved water drainage, ease of maintenance and noise absorption. However, any substantial turf area 32 produces some benefit. The turf areas 32 are adaptable so as to be installed to match any shape or contour created by the runways or taxiways 34, airport fences 36, or by any other roads, driveways, accessways, pathways, trees, bushes, buildings, terminals, garages, hangers (not illustrated), or any other structures associated with an airport or airfield. The turf areas 32 likewise are adaptable so as to accommodate any interior obstruction, such as runway lights 40, or other uses (if desired by the airport operator), drains or drainage ways 42, access roads, buildings, garages, hangers (not illustrated), or any other structures associated with an airport or airfield. One interface between the turf areas 32 is described below.

The present disclosure includes a turf area 32 having a distance perpendicular to a runway/taxiway 34. Turf areas 32 can extend perpendicularly at least 150 to 300 feet (45 to 90 m) transversely from the runway/taxiway to help provide a proper bird strike reduction. Many airports contain parallel runways less than 300 feet (90 m) apart. In such cases, turf areas 32 may extend from runway to runway (including from runway to taxiway and from taxiway to taxiway). As illustrated, the present disclosure contemplates installing turf areas 32 on both sides of the runways or taxiways 34 and one or more of the ends of the runway/taxiway. Again, to help prevent bird strikes, the turf in one embodiment is installed 150 to 300 feet (45 to 90 m) perpendicular to the end of the runway/taxiway 34.

Figure 2:
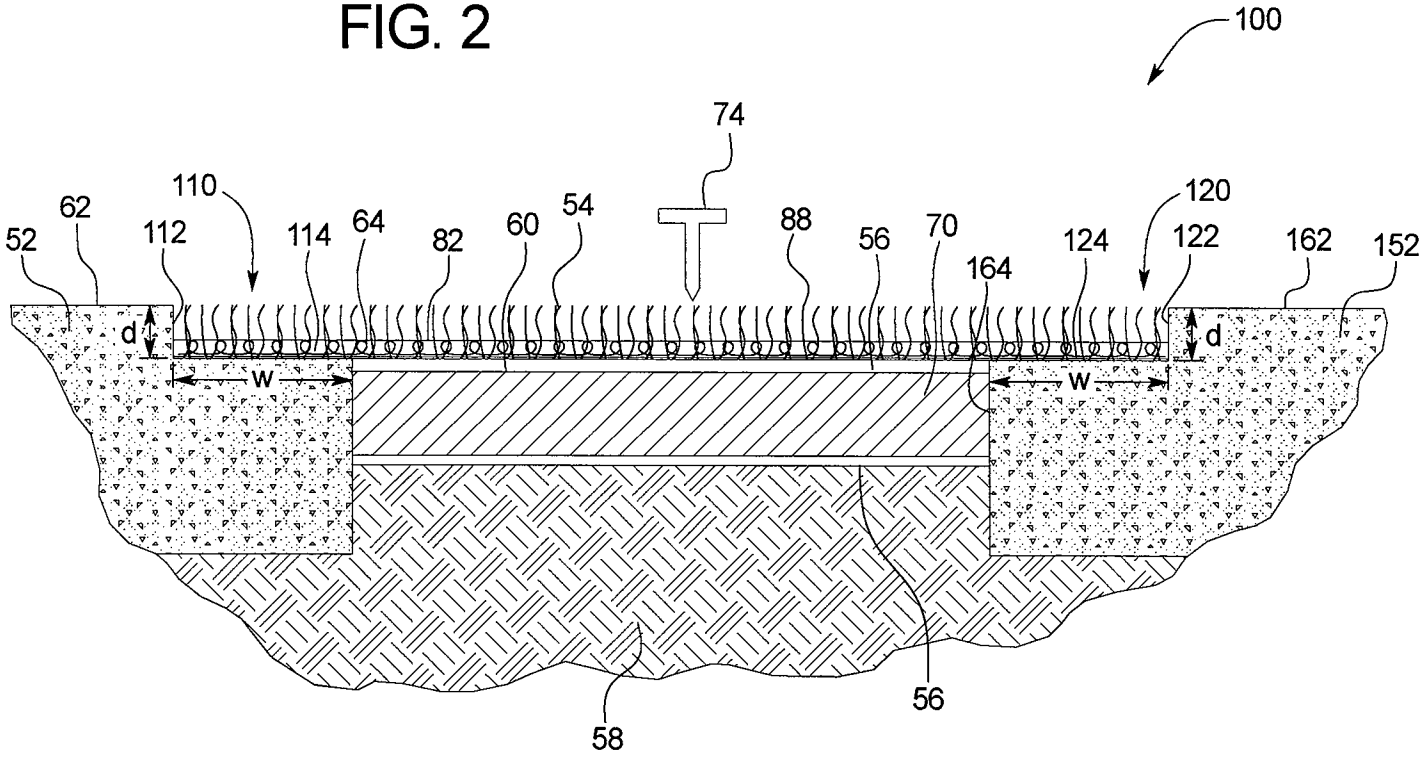
FIG. 2 is a sectioned cross-sectional view, taken along line II-II of FIG. 1, illustrating an embodiment of an artificial turf system of the present disclosure including an airport runway or taxiway having a removed or milled surface, an artificial turf adhesively secured to the new, removed or milled surface and an infill layer installed on the turf.

Referring now to FIG. 2, one embodiment of a system 100 of the present disclosure taken along the section line II-II of FIG. 1 is illustrated. It should be appreciated that the systems and methods of the present disclosure can include runway 52 (including any shoulder(s) of runway 52), turf 54, soil 58, weed barrier 56 and base layer 70 as well as the procedures for imbedding, excavating, scarifying and grading discussed. System 100 includes an airport runway/taxiway section 52 adjacent to artificial turf 54 and can include an accompanying sub-surface having one or more weed barriers 56. To install system 100, in an embodiment an installer: (i) excavates, grades, scarifies and compacts an application specific amount, volume or depth of the soil 58 to create a desired soil surface 60 (for existing airports and in certain instances for a new airport); (ii) installs weed barrier 56 onto soil surface 60; (iii) glues and ramsets a composite stud or member 66 using a suitable non-toxic glue and ramset 68; (iv) installs a two inch (5 cm) artificial turf by sewing separate adjacent and interior sections of turf together as necessary, pulling the sewed section(s) taught, and driving pinning devices 74 in a grid pattern to secure the turf before applying an infill 82; and (v) applying an application specific infill layer 82 (e.g., non-uniform sand) to an application specific height (e.g., one inch (2.5 cm) below tips of the turfs grass-like fibers).

More specifically, FIG. 2 illustrates an existing runway/taxiway section 52 (including any shoulder(s) of runway or taxiway 52) imbedded in existing soil 58. The thickness or depth of airport runways or taxiways varies in accordance with airport or airfield engineering specifications. Many existing runways or taxiways are 18 inches (45 cm) thick or deep. Soil 58 includes a soil top surface 60 that is maintained below a runway/taxiway top surface 62, and which abuts a side wall 64 of the runway/taxiway 52. To aid in the description of the present disclosure, the term runway if used alone can refer to any one or more of a runway, a taxiway or any other road traveled by airplanes as well as any shoulder(s) of the runway(s) and/or taxiway(s).

In some applications of the present disclosure an initial excavation of approximately six to ten inches (15 to 25 cm) of soil near a side wall 64 is required. In a new airport installation, soil surface 60 can be graded initially to the appropriate specifications. For cost reasons, it is not desirable to excavate any deeper than necessary. The top of synthetic turf 54, i.e., the tips of synthetic grass blades, can be approximately even with or slightly below the runway top surface 62 at wall 64. System 100 can also include a suitable base material 70 providing structural stability, water absorption and a life retarding environment as described in more detail below. The present disclosure can include an average initial excavation of six inches (15 cm) of soil 58 at the side wall 64 of airport runway 52.

Although not illustrated in FIG. 2, soil top surface 60 can be graded such that system 50 enables water to drain away from the runway. For example, in FIG. 2, water can drain from left to right and soil surface 60 is graded so that the soil is higher near the side wall 64. The grade as well as the depth of excavation is application specific. That is, a particular airport can have a drainage system in place whereby the grade beginning at the runway side wall 64 is much steeper than normal.

In such a case, the present disclosure contemplates working with and enhancing the initial engineering plan and keeping the original grade. It should be appreciated that the present disclosure can include any of the drainage systems described at FIGS. 3, 7 and 8 of U.S. Pat. No. 7,175,362, entitled, "Synthetic Covering Systems for Safety Areas of Airports", the entire contents of which are incorporated herein by reference and relied upon.

Assuming that the application does not have a drainage system in such proximity to runway side wall 64, soil top surface 60 is graded at approximately two percent in one embodiment. That is, for every foot (30 cm) measured from left to right from the runway side wall 64, the surface level drops ¼ inch (0.62 cm). If possible, system 100 maintains a constant grade, so that a 150 foot (45 m) application is gradually excavated to approximately three additional feet (90 cm) of soil from the side wall 64 to the end, 150 feet (45 m) away.

Certain airports have been engineered to handle or properly drain a one-hundred-year flood, which requires more or less drainage depending upon the geographic location of the airport. Certain airports have existing retention or detention ponds that may or may not be functioning properly. It is therefore probable that at some distance from the runway, the application of system 50 can include a grade that departs, slightly or radically, from the two percent grade. It is conceivable that system 100 grades certain areas of the airfield as much as sixty to seventy percent, or to whatever percentage is most beneficial to the airport.

Additionally, system 100 can use a scarified and compacted soil surface 60. Most surface soil exists at approximately eighty-eight percent compaction. That is, surface soil is comprised of approximately twelve percent air. Soil 58 can be compacted on its surface 60 to between ninety and ninety-seven percent. In various embodiments, before compacting, scarifying can be used, i.e., breaking up or roughing up the soil, similar to a rototile. Approximately four inches of the unexcavated topsoil 58 is scarified. Scarification enables better compaction, which aids in providing a firm base.

Suitable scarification equipment is commercially available and well known in the art. For instance, a four-ton double drum roller can be used to compact soil 58. A sheep's-foot compactor can also be employed, which contains a device for stirring up the soil as it compacts the soil.

Artificial turf system 100 can include weed barrier 56 on top of soil 58. Weed barrier 56 can be laid onto the compacted soil surface shortly before installing a base material 70, as described below. Weed barrier 56 can be plastic or other fabric, that retards upward weed growth and allows a steady and unimpeded flow of water in the opposite direction, i.e., downward. Weed barrier is woven, thermally bonded or otherwise suitably formed. One suitable thickness is four mils. One weed barrier contemplated by the present disclosure is a Polyspun 350 brand drainage/weed control fabric made by Landmaster Products of Engelwood, Colo.

Weed barrier 56 prevents weeds or other plants as well as grubs or worms from traveling from the soil surface 60 through the remainder of system 100. Weed barrier 56 also enables water to flow from system 100 into soil 58. The maximum allowable rate of water that can flow through weed barrier 56 is equal to or greater than the maximum rate of water that can flow through the remainder of system 50, including synthetic turf 54. The rate of water through standard synthetic turf is 25 to 50 gallons per hour per square foot, which the weed barrier 56 of the present disclosure is capable of handling. The weed barrier product described above is believed to handle 300 gallons per minute per square foot.

Weed barrier 56 also functions as a mat or cover that provides stability as the remainder of the system is installed. When soil 58 is compacted it is in an unnatural condition whereby wind, machinery, workers, etc., can kick up the soil 58, adding air to it and lessening the level of compaction. Weed barrier 56 counteracts the tendency for soil 58 to decompress by not allowing the soil surface 60 to be easily disrupted. Accordingly, a heavier or thicker weed barrier 56, e.g., ⅛ inch, (0.31 cm) can be used in certain installations to provide additional stability on unstable soil.

Artificial turf system 100 can also include base material 70 that characteristically or inherently retards plant and animal life, absorbs water and enables water to drain through to weed barrier 56 between base material 70 and soil surface 60 and provides a firm and stable foundation for synthetic turf 54. Base material 70 includes any material having such characteristics including, but not limited to: rock, crushed rock, concrete, or any combination thereof. Base material 70 also can include sand in combination with rock, crushed rock or concrete. It is accordingly expressly contemplated that any of the systems and methods described herein be installed over existing concrete or asphalt located between and around existing runways and taxiways 34 at airport 30. In such applications, excavation may not be necessary, however, steps may be taken to repair cracks in the existing concrete or asphalt before placing turf 54 thereon.

Base material 70 can be a state approved road base, for example, ¾ inch (1.87 cm) minus road base, which is commonly used in the construction of roads. Road base approved by the state or other regulatory authority is installed when possible. Each state has an approved road base material, such as ¾ inch (1.87 cm) minus road base. Three quarter inch (1.87 cm) minus road base includes crushed rock and binder, wherein the largest rocks have an average diameter of ¾ inch (1.87 cm). The binder material is smaller fragments of rock including sand sized rock pieces.

After base material 70 is placed onto weed barrier 56, base material can be smoothed and compacted. System 100 can include the processes described herein for compacting a crushed rock base material 70 in a manner similar to compacting soil surface 60. Those skilled in the art of soil excavation and road base installation commonly compact crushed rock or road base. For example, a four-ton double drum roller can be used to compact base material 70. Alternatively or additionally, a sheep's-foot compactor is used to compact base material 70. The sheep's-foot compactor contains an additional device for stirring up the base material. Optimally, the crushed rock and binder is wetted with water while compacting the base material.

Artificial turf system 100 includes installing a crushed rock road base that is tested and found to be compacted to at least ninety percent (i.e., ten percent air or less) and from ninety-five to ninety-seven percent or above in various embodiments. Upon compaction, the dust and smaller rocks of the road base fill the interstices between the larger rocks, creating a very solid stable base that can approach 100% compaction. In that manner, base material 70 is able to support the weight of an aircraft or airplane. That is, the base 70 at least supports the weight of small aircraft in small airfield applications and supports the weight of any large aircraft or airplane in commercial or military airport applications.

The height h of base material 70 is application specific and can be equal to the depth of the excavation along runway wall 64 less the height of the artificial turf 54 in one embodiment. That is, the fiber tips are substantially parallel with or slightly below runway surface 62 at the side wall 64 in one embodiment. The tips are alternatively above the runway surface 62.

In an application involving a six inch (15 cm) excavation and two inch (5 cm) high turf 54, the height h of the base material 70 is thus four inches (10 cm).

Alternatively, if system 100 employs pure sand or a ¼ inch (0.62 cm) minus crushed stone as a base material 70, in an application having a very stable soil surface 60, the height h is as little as ½ inch (1.25 cm). Further alternatively, the height h is as deep as 2 feet (60 cm), wherein the system 50 provides for maximum stability and water absorption.

System 100 can include a second weed barrier 56 installed on top of base material 70 beneath artificial turf 54. Artificial turf 54, which in an embodiment weighs approximately ten pounds per square foot with a dry infill layer, which helps to secure upper weed barrier 56 onto base material 70. Upper weed barrier 56 in one embodiment is the same weed barrier that is installed on soil surface 60 and has the same water flow though capability as does the lower weed barrier 56. System 100 can therefore provide flow-through drainage. Turf 54 can alternatively or additionally be held in place with one or more pinning devices 74 that are driven through the artificial turf and weed barrier 74 to whatever substrate lies beneath the turf 54 such as base material 70.

The weed barriers could be different for cost saving purposes, where it is contemplated that a more expensive weed barrier is applied on soil surface 60, wherein weeds are more likely to propagate. Moreover, system 100 contemplates not providing an upper weed barrier 56 in certain applications. For example, in certain areas, such as North Dakota, the soil is relatively alkaline such that weeds do not tend to grow, and so that an upper weed barrier 56 is not necessary. System 100 can include a lower weed barrier 56, even in an alkaline soil application, as added protection and to take advantage of the weed barrier's stabilizing effect.

System 100 can be used in a geographical area that is generally able to dry after receiving precipitation. That is, system 100 can absorb substantial rain and remains stable throughout if the weather eventually allows the system to dry. If soil 58 becomes saturated from continuous precipitation, system 100 can become less stable. By varying the height h, the absorption and stability of the system is altered to match the amount of precipitation that system 100 receives. As stated above, system 100 can also employ an airport's existing water retention and detention systems and thereby lessen the drainage burden on the system. System 100 is therefore applicable to many airport or airfield applications of the present disclosure.

Figure 3:
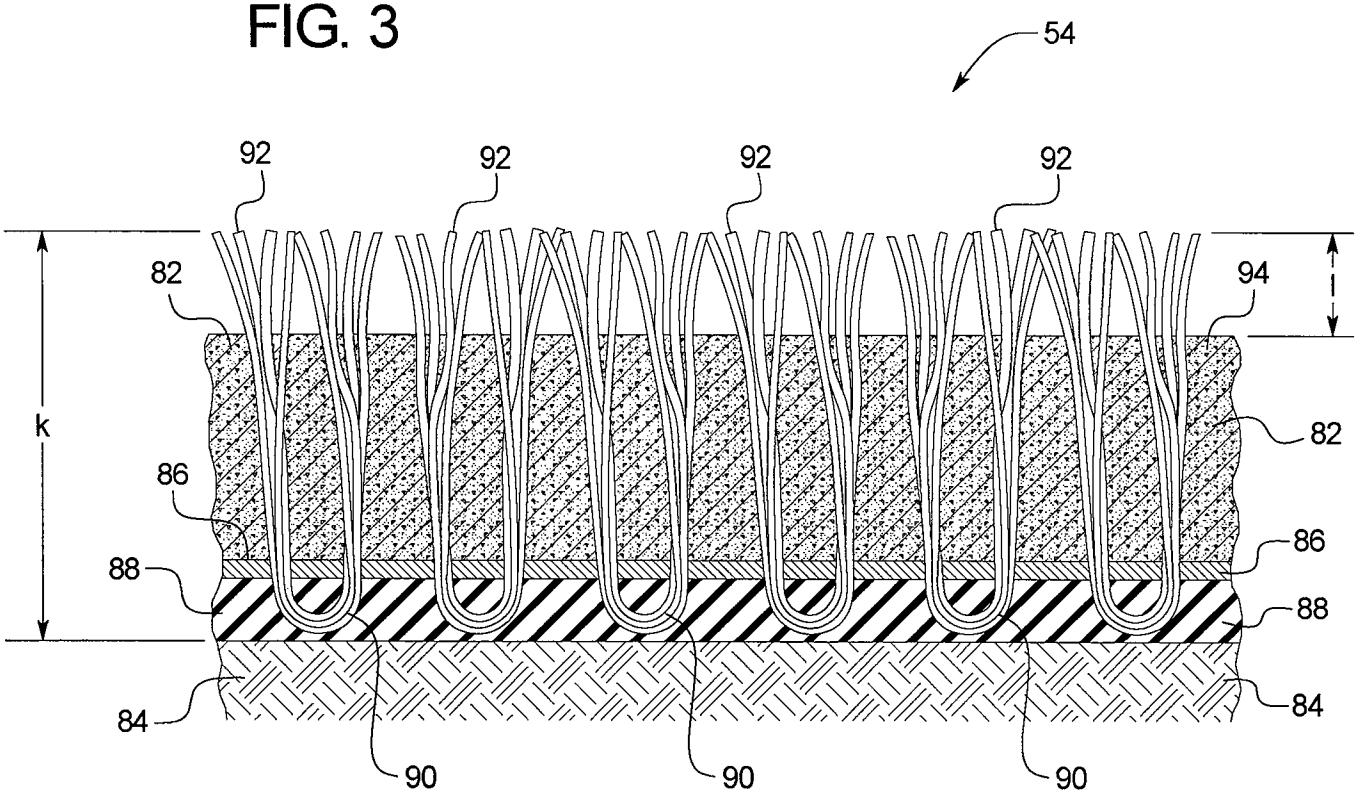
FIG. 3 is a sectioned front elevation sectional view of an artificial turf that can be used with the systems and methods of the present disclosure.

Referring additionally to FIG. 3, one suitable embodiment for artificial turf 54 is illustrated. Artificial turf 54 of FIG. 3 includes an infill layer 82 that can be used with any of the systems and methods of the present disclosure. Turf 54 of FIG. 3 is laid over a sheet 84. Sheet 84 is a weed barrier in one embodiment. In such an embodiment, sheet 84 includes a waterproof membrane. In certain applications, there is no weed barrier or waterproof membrane, in which case the turf lays upon base material 70. The turf, e.g., a 12 or 15 foot (3.6 or 4.5 m) roll of the flexible turf 54 includes a primary flexible backing 86 (e.g., of double woven polypropylene) and a secondary flexible backing 88, which can be polyurethane. The thickness of the primary flexible backing 86 is provided by the manufacturer. The thickness of the secondary flexible backing 88 is between 10 and 20 mils in one embodiment.

Turf 54 of FIG. 3 includes a plurality of fibers 90, which are tufted or stitched into the primary backing 86. The secondary backing 88, applied after tufting or stitching, covers some or all of the stitch depending on the thickness of the secondary backing 88. Turf 54 of FIG. 3 includes 19 tufts or stitches per every three inches (7.5 cm). The fibers 90 are fribulated (i.e., separate filaments which remain connected at certain points so that the yarn if stretched apart creates a honeycombed mesh) in one embodiment to form separate grass-like strands 92. Fibers 90 are polypropylene, 7500 denier and 32 ounces per square yard in one embodiment. Polypropylene has superior melting point and wear ability verses other materials, is adapted to be sprayed with pesticides and herbicides, does not degrade upon contact with toxic jet fuel and limits the spread of fire from a fuel spill due to its fire retardant characteristic.

The height of grass-like strands 92, k, above the bottom of the secondary backing 88 is ½ inch to six inches (1.25 to 15 cm), and specifically 1½ to 2½ inches (3.75 to 6.25 cm) and 2 inches (5 cm). The individual fribulated or slit filaments are twisted together near the stitched end and come apart at the top. Turf 80 includes a twisted fiber. Alternatively, the manufacturer makes fibers 90 flat, so that the individual grass-like strands 92 stack one on top of the other. Turf 54 of FIG. 3 can be of either style.

Infill layer 82 is a material that characteristically or inherently retards plant and animal life, absorbs and enables water to drain through to primary backing 86 and secondary backing 88 and provides a firm and stable foundation for the fibers 90. Infill layer 82 can also help to absorb and reduce the noise coming from jet engines. Infill layer 82 includes any material having these characteristics including, but not limited to: rock, sand, concrete, plastic, fiberglass, rubber, ceramic material, cork, or any combination or derivative thereof.

Infill layer 82 is crushed rock or sand and washed sand in one embodiment. In certain instances, e.g., in the rainy Northwest, the infill layer can be ¼ inch (0.62 cm) minus crushed rock (i.e., 1¼ inch (0.62 cm)) average diameter rock down to rock particles) to enhance drainage. Referring to the terminology used in connection with FIG. 1, infill layer 82 includes resilient materials, such as: (i) granulated cork; (ii) rubber particles including natural rubber or synthetic rubber; (iii) beads of synthetic polymers e.g., vinyl chloride, vinyl ethers, vinyl acetate, acrylates and methacrylates, polyvinylidene chloride, urethanes, polyamids and polyesters; (iv) synthetic polymer foam particles; (v) vinyl foams, e.g., polyvinyl chloride foams, polyvinyl ether foams, foamed polystryene, foamed polyurethanes and foamed polyesters; and (vi) foamed natural rubber.

Turf 54 of FIG. 3 includes a compacted infill layer 82 of variable sand particles. A four-ton double drum roller may be used to make one or more passes over the turf 80. The length 1, which is the average distance between the tips of the grass-like strands 92 and a top surface 94 of the infill layer 82, is ⅛ to 5 inches (0.31 to 12.5 cm) in one embodiment, given that the contemplated variable turf height of the grass-like strands 92, k, above the primary backing 86 is ½ inch to six inches (1.25 to 15 cm). The runway application of turf projects an inch (2.5 cm) of the grass-like strands 92 above infill surface 94, wherein the free ends of strands 92 shield the sand infill 82 from the weather and from any air flow created by a jet or prop engines. Thus, in an application wherein the grass-like strands 92 are two inches (5 cm) high, the infill layer 82 is about one inch (2.5 cm) high, leaving a distance 1 of about one inch (2.5 cm). In various embodiments of the system and methods of the present disclosure, the infill layer 82 is installed so that there is approximately five pounds per square foot of infill layer 82 installed on the portion of the artificial turf. It should be appreciated that any suitable amount of infill can be used in the systems and methods of the present disclosure that helps to secure the artificial turf, enhance drainage reduce noise.

It should be appreciated that the artificial turf 54 used in the systems and methods of the present disclosure can alternatively be a prickly or repelling turf with spiny or bared fibers as described, for example, at FIG. 12 of U.S. Patent No. incorporated above, or can be a multi-pigmented, marking or advertising turf as described, for example, at FIG. 15 of U.S. Pat. No. 7,175,362 incorporated above.

Figure 4:
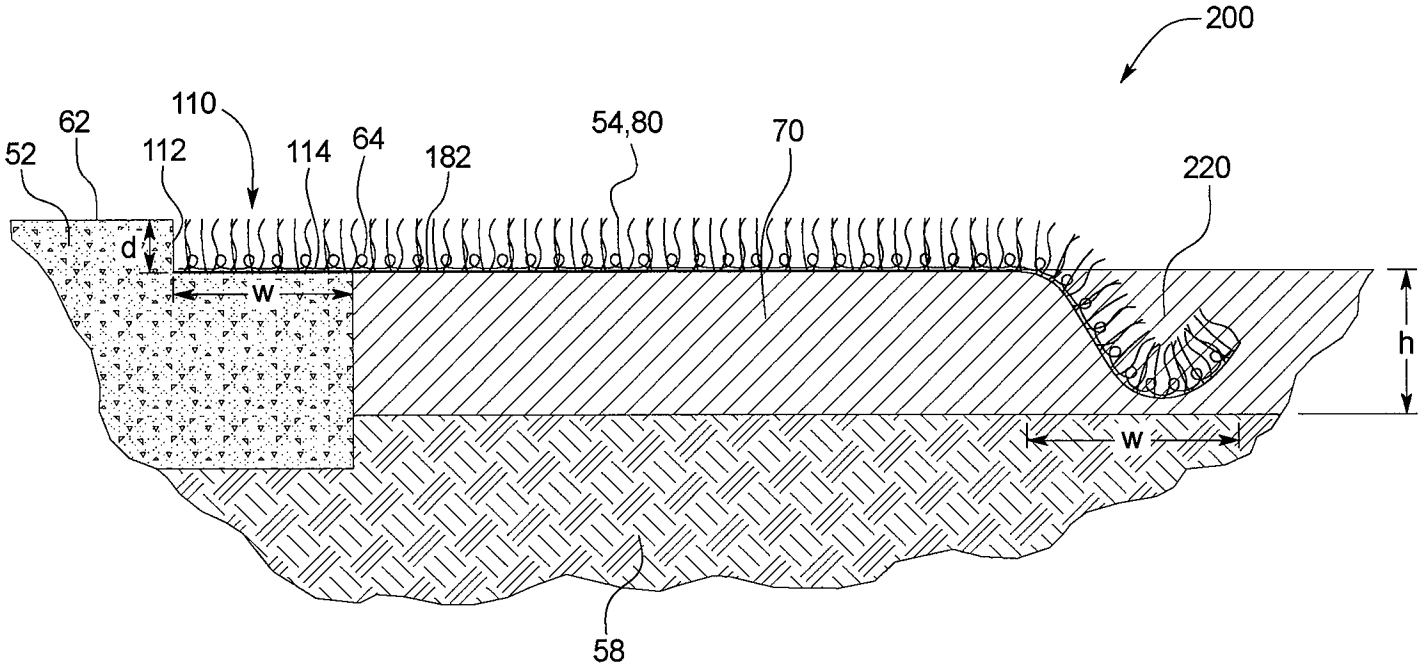
FIG. 4 is a sectioned cross-sectional view, taken along line IV-IV of FIG. 1, illustrating an embodiment of an artificial turf system of the present disclosure including an airport runway or taxiway having a new, removed or milled surface, an artificial turf adhesively secured to the removed or milled surface, an infill layer installed on the turf and a section of the turf buried in a base material.
Figure 5:
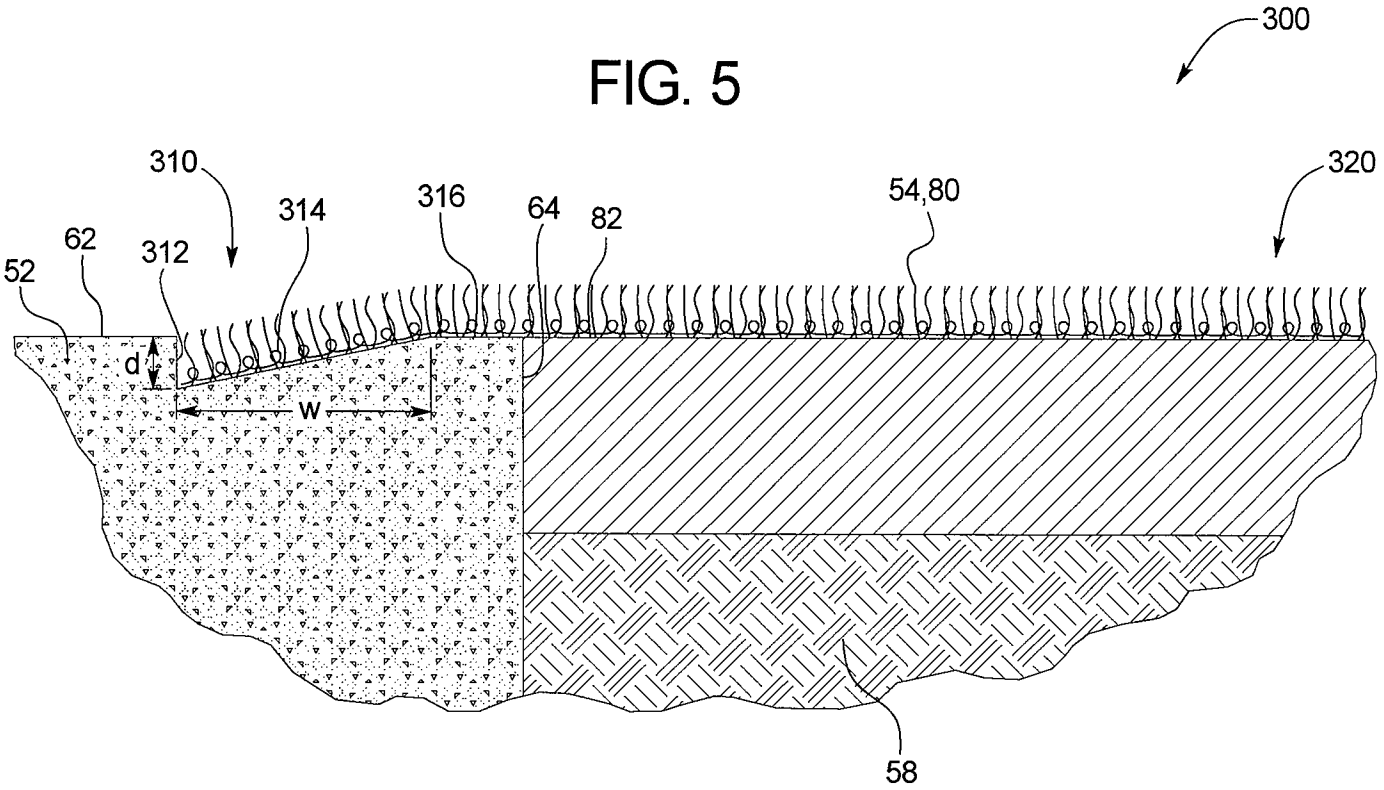
FIG. 5 is a sectioned cross-sectional view, taken along line V-V of FIG. 1, illustrating an embodiment of an artificial turf system of the present disclosure including an airport runway or taxiway having a removed or milled surface that is tapered downwardly from an existing edge of the runway or taxiway, an artificial turf adhesively secured to the new, removed or milled surface and an infill layer installed on the turf.

Turning now more specifically to FIGS. 2, 4 and 5, FIGS. 2, 4 and 5 illustrate embodiments of airport artificial turf systems and methods of installing artificial turf around airports and airfields of the present disclosure. It should be appreciated that the systems of FIGS. 2, 4 and 5 can, but do not have to, include the systems and methods of mechanical pinning, excavating and placing of weed barriers described above.

Referring specifically to FIG. 2, FIG. 2 illustrates an embodiment of an airport artificial turf system 100 with existing runway 52 (including any shoulder(s) of runway 52) and opposing runway or taxiway 152 (including any shoulder(s) of runway 152) each imbedded in existing soil 58 as described above. Runway surface 62 has been removed, milled or otherwise modified to a depth "d" and width "w" to define for the existing runway a new, removed or milled surface 110 and a new, removed or milled sidewall 112. Removed surface 110 begins at the existing sidewall or edge 64 of runway 52 and extends to a new or removed milled sidewall 112. Similarly, opposing runway surface 162 of opposing runway 152 has been removed or milled to a depth d and width "w" to form a new removed or milled surface 120 and a new removed or milled sidewall 122. The milling of the opposing surfaces 62 and 162 can be to the same depth "d" and/or width "w" or to a different depth "d" and/or width "w". Removed surface 120 begins at the existing sidewall or edge 164 of runway 152 and extends to new removed or milled edge 122.

Section 114 of artificial turf 54 is adhered to removed surface 110 using suitable glue, such as non-toxic PL400 glue by 3M. Similarly, section 124 of artificial turf 54 is adhered to removed surface 120 of opposing runway 152 using a suitable glue. In various embodiments, the width of the area of turf 54 that is adhered to the removed surfaces of runways 52, 152, respectively, has a dimension that is less than the width of the removed surfaces 110, 120. In an embodiment, the width of the area of turf 54 adhered to the removed surface 110, 120 ranges from a minimum of about one foot from the existing edge 64, 164 of the runway to about 100% of the removed surface 110, 120. Turf sections 114 and 124 can be of a continuous, larger piece or be sewn, glued or otherwise secured together from smaller pieces of turf as desired.

Equipment for removing, modifying, milling or otherwise machining surfaces of runways 52, 152 to create the new surfaces of the present disclosure are commercially available and well-known. For instance, a Bobcat® machine with a milling attachment can be used to create the new surfaces of runways 52, 152 of the present disclosure. It should be appreciated that any other suitable equipment can be used to remove, modify, mill, or otherwise machine the existing surfaces of runways 52, 152 to create the new surfaces of runways 52, 152.

In one embodiment of the present disclosure, the existing runway surfaces 62, 162 are (i) removed or milled downwardly to about 80% to about 100% of the height of artificial turf 54 or grass blades for the turf (e.g., a depth in the range of about one and one-half inches to about three inches), and (ii) removed or milled inwardly to a width of up to ten feet. In another embodiment, the width of the removed surface is approximately five feet from the existing edge of the runway 52, 152. It should be appreciated that the dimensions of the removed surface of the runway can be any suitable dimensions that enable the artificial turf to be securely installed around the runway.

By removing or milling a surface of an existing runway 52, 152 and adhering a section of artificial turf 54 to the removed surface, it should be appreciated that the artificial turfs of the present disclosure can be securely installed around the airport without requiring any headers, mechanical pinning devices, and/or even the turf infill layer 82. The systems and methods of the present disclosure accordingly avoid costs and problems associated with existing header systems and other airport artificial turf securing methods, while still providing an edge (i.e., the new milled edge described above) to protect the turf from large jet blasts and natural forces. It should be appreciated that pinning devices 74 may be used if needed or desired.

It should be appreciated from the foregoing description that a method for securely installing an artificial turf system of the present disclosure includes removing or milling a portion of an existing runway (including any shoulder(s) of the runway) to a specific depth and width (e.g., a depth in the range of about one and a half inches to about three inches and a width ranging up to ten feet), adhering a section of artificial turf to the removed or milled surface of the runway and installing an infill layer on at least a portion of the runway. The method also includes installing a compacted base material underneath at least a portion of the artificial turf. The method also can include any of the systems and methods for excavating, weed barrier placement, compacting and pinning discussed above.

Turning now to FIG. 4, FIG. 4 illustrates another embodiment of an airport artificial turf system 200 of the present disclosure. Airport artificial turf system 200 is similar to system 100, including artificial turf 54 runway 52 (including any shoulder(s) of runway 52), existing top surface 62 of runway 52, compacted base 70, soil 58 beneath the base 70 and an infill layer 82. However, unlike system 100, system 200 is not adhered to a different, opposing runway 152. Instead, system 200 includes section 220 of turf 54 that is buried at its distal end in a trench of underlying base material 70. In an embodiment, the section 220 of turf 54 that is buried at its distal end in the trench has a width "w" of approximately two feet and a depth "d" of approximately two feet. It should be appreciated that the section of turf that is buried can be buried at any width and depth suitable to help secure the turf around the runway.

It should be appreciated from the foregoing description that a method for securely installing an artificial turf system of the present disclosure includes removing or milling a portion of an existing runway (including any shoulder(s) of the runway) to a specific depth and width (e.g., a depth in the range of about one and a half inches to about three inches and a width ranging up to ten feet), adhering a section of artificial turf to the removed or milled surface of the runway and installing an infill layer on at least a portion of the runway. The method also includes installing a compacted base material underneath at least a portion of the artificial turf and burying an opposing or distal section of the artificial turf in the compacted base material. The method also can include any of the systems and methods for excavating, weed barrier placement, compacting and pinning methods and systems discussed above.

Turning now to FIG. 5, FIG. 5 illustrates another embodiment of an airport artificial turf system 300 of the present disclosure. System 300 is similar to systems 200 and 300, and includes artificial turf 54, runway 52 (including any shoulder(s) of runway 52), existing top surface 62 of runway 52, soil 58, base material 70 and infill layer 82 installed onto turf 54. However, unlike systems 100 and 200, the runway surface 62 of system 300, has been removed or milled at an angle extending downwardly from an existing edge 64 of the runway surface so as to form a tapered removed surface 310 with new removed sidewall 312. The tapered and removed surface 310 has a depth "d" that decreases in a direction extending from the removed sidewall 312 to the existing sidewall 64. In an embodiment, the depth "d" at the removed sidewall is about 80% to 100% of the height of the artificial turf or artificial blades of grass for turf 54 (e.g., a depth in the range of one and one-half inches to about two or about three inches). It should be appreciated that the tapered and removed surface 310 can include any suitable angle that forms an edge to protect turf 54 from engine jet blasts and natural forces.

The width "w" of the removed surface 310 in an embodiment is in the range of about three to ten feet. As illustrated, a section 316 of artificial turf 54 lies on top of a portion of existing runway 52 that has not been removed or milled (i.e., the section to the right of the tapered removed surface shown in FIG. 5) and a section 314 of artificial turf 54 lies on top of the new removed surface 310. In an embodiment, only the section 316 of artificial turf 54 that lies on top of the removed and tapered surface 310 of runway 52 is glued to the runway 52. In another embodiment, both section 314 and section 316 are glued to the runway 52.

The angle at which the surface of runway 52 is milled in an alternative embodiment deepens as the removed or milled surface extends outwardly towards the existing sidewall 64 of runway 52, as opposed to a surface extending deeper inwardly of runway as shown in FIG. 5. The alternative outwardly deepening surface of runway 52 can drop to a level that meets the ground or base material level 70 in an embodiment. The alternative angled removal or milling helps to direct rainwater away from the runway.

It should be appreciated that opposing section 320 of turf 54 can be adhered to a different opposing runway (e.g., secured to runway 152 including any shoulder(s) of runway 152, as described in connection with FIG. 2 above) or secured via burying section 320 in a trench of base material 70 (e.g., as described in connection with FIG. 4 above). It should also be appreciated from the foregoing description that artificial turfs 54 of systems 100, 200 and 300 can be securely installed around an entire perimeter of an existing runway or taxiway (including any shoulder(s) of the existing runway or taxiway). That is, viewing FIG. 1, an entire perimeter P of an existing runway or taxiway surface 34 can be removed, milled or otherwise modified to a specific depth and artificial turf can be adhered to the entire removed perimeter of the runway or taxiway surface.

It should additionally be appreciated from the foregoing description that a method of installing artificial turf according the embodiment of FIG. 5 includes removing or milling an airport runway surface (including any shoulder(s) of the runway surface) so that a portion of the runway surface is tapered downwardly or upwardly from an edge of the turf, adhering a section of artificial turf to the removed and tapered runway surface and applying an infill to at least a portion of the artificial turf.

In another embodiment of the present disclosure, an airport/airfield artificial turf system includes artificial turf that is configured to provide a soft or cushioned landing area for parachuters at, for example, an airport or airfield. The system of this embodiment can include many of the materials and methods described above in connection with systems 100, 200 and 300, such as turf 54, soil 58 and base material 70. This system, however, includes a 100% rubber infill installed onto the artificial turf. The 100% rubber infill provides the cushioned or soft landing area for parachuters. In an embodiment, the 100% rubber infill layer includes (i) particles of natural or synthetic rubber, and/or (ii) foamed natural rubber. The landing system may also have one or more layer of padding beneath the artificial turf. The padding may be porous or perforated for drainage. In various embodiments, the padding is sloped to provide for drainage of water.

The parachute landing system can have suitable markings for guiding and evaluating a parachuted landing. Indeed any of the systems and methods can employ airport markings and other text, such as advertising and logos. Systems and methods for such markings are illustrated and described in U.S. Patent Publication No. 2010/0030709, incorporated herein expressly by reference and relied upon.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method for installing artificial turf at an airport or airfield comprising:
   - removing only an edge portion of an airport runway or taxiway so as to define a new surface only at the edge portion of the runway or taxiway;
   - adhering, via an adhesive, a section of artificial turf directly to the new surface at the edge portion of the runway or taxiway; and
   - applying an infill to at least a portion of the artificial turf.

2. The method of claim 1, which includes installing a base material under at least a portion of the artificial turf.

3. The method of claim 2, wherein installing the base material includes installing any one of: (i) rock, (ii) crushed rock, (iii) concrete, or (iv) combinations thereof.

4. The method of claim 1, wherein removing only the edge portion of the airport runway or taxiway includes milling the portion of the runway or taxiway to at least one of (i) a depth ranging between about one and one-half inches to about three inches, and (ii) a width ranging up to ten feet.

5. The method of claim 1, which includes removing only the edge portion of the runway or taxiway so as to define a tapered surface only at the edge portion of the runway or taxiway.

6. The method of claim 1, wherein removing only the edge portion of the runway or taxiway includes milling only the edge portion of the runway or taxiway inwardly and downwardly towards a center of the runway or taxiway.

7. The method of claim 1, wherein removing only the edge portion of the runway or taxiway includes milling the runway or taxiway outwardly and downwardly towards the edge of the runway or taxiway.

8. The method of claim 1, which includes removing only an edge portion of a second airport runway or taxiway so as to define a new surface only at the edge portion of the second runway or taxiway, and adhesively securing, via an adhesive, a different section of the artificial turf directly to the new surface at the edge portion of the second runway or taxiway.

9. The method of claim 1, which includes burying a section of the artificial turf opposing the adhered section.

10. The method of claim 1, wherein the edge portion of the airport runway or taxiway includes a shoulder of the runway or taxiway.

11. The method of claim 1, wherein removing only the edge portion of the runway or taxiway includes milling a perimeter of the runway or taxiway and adhering the artificial turf to the milled perimeter.

12. A method for installing artificial turf at an airport or airfield comprising:

removing only an edge portion of an airport runway or taxiway so as to define a tapered surface only at the edge portion of the runway or taxiway;

adhering, via an adhesive, a section of artificial turf directly to the tapered surface at the edge portion of the runway or taxiway; and applying an infill to at least a portion of the artificial turf.

13. The method of claim 12, which includes additionally adhering the artificial turf to a surface of the airport runway or taxiway that is not tapered.

14. The method of claim 12, wherein removing only the edge portion of the airport runway or taxiway includes removing the portion so as to define a tapered surface that extends inwardly and downwardly beginning at the edge of the runway or taxiway.

15. The method of claim 12, wherein removing only the edge portion of the airport runway or taxiway includes removing the portion so as to define a tapered surface that extends outwardly and downwardly towards the edge of the runway or taxiway.

* * * * *